US008733215B1

(12) United States Patent
Kravitch

(10) Patent No.: US 8,733,215 B1
(45) **Date of Patent: *May 27, 2014**

(54) TOOLS FOR OPERATION IN LIMITED WORK SPACE

(71) Applicant: Nick C. Kravitch, Aliquippa, PA (US)

(72) Inventor: Nick C. Kravitch, Aliquippa, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/815,673

(22) Filed: Mar. 14, 2013

Related U.S. Application Data

(63) Continuation of application No. 13/373,059, filed on Nov. 3, 2011, now Pat. No. 8,424,424, which is a continuation of application No. 11/401,431, filed on Apr. 10, 2006, now Pat. No. 8,065,938.

(51) Int. Cl.

| | |
|---|---|
| ***B25B 13/48*** | (2006.01) |
| ***B25B 23/16*** | (2006.01) |
| ***B25B 23/00*** | (2006.01) |
| ***B25G 1/02*** | (2006.01) |
| ***B25G 1/04*** | (2006.01) |
| ***B25G 1/06*** | (2006.01) |

(52) U.S. Cl.
CPC ..... *B25B 13/48* (2013.01); *B25B 13/481* (2013.01); *B25B 23/0021* (2013.01); *B25B 23/0035* (2013.01); *B25G 1/025* (2013.01); *B25G 1/043* (2013.01); *B25G 1/063* (2013.01)
USPC ..... 81/177.2; 81/177.7

(58) Field of Classification Search
USPC ..... 81/119, 177.2, 177.5, 177.6, 177.7, 81/177.75
See application file for complete search history.

(56) References Cited

U.S. PATENT DOCUMENTS

| | | | | |
|---|---|---|---|---|
| 1,398,234 | A * | 11/1921 | Landis | 81/450 |
| 1,533,619 | A * | 4/1925 | Thompson | 403/328 |
| 3,002,409 | A * | 10/1961 | Jones | 81/177.2 |
| 3,270,597 | A * | 9/1966 | Neff et al. | 81/177.9 |
| 3,802,303 | A * | 4/1974 | Evans et al. | 81/185 |
| 4,768,405 | A * | 9/1988 | Nickipuck | 81/177.85 |
| 4,824,280 | A * | 4/1989 | Alter | 403/322.2 |
| 5,442,980 | A * | 8/1995 | Ringer | 81/177.85 |
| 5,697,269 | A * | 12/1997 | Tseng | 81/177.6 |
| 6,092,441 | A * | 7/2000 | Jarvis | 81/177.2 |
| 6,135,607 | A * | 10/2000 | Cook | 362/119 |
| 6,336,382 | B2 * | 1/2002 | Cerda | 81/60 |
| 6,543,313 | B2 * | 4/2003 | Samudosky | 81/57.29 |
| 6,651,532 | B1 * | 11/2003 | Whitelock et al. | 81/57.29 |
| 6,782,777 | B1 * | 8/2004 | Wei | 81/177.85 |
| 6,976,411 | B1 * | 12/2005 | Yu | 81/177.2 |
| 7,155,998 | B1 * | 1/2007 | Shyu | 81/60 |
| 7,182,000 | B1 * | 2/2007 | Dicksen | 81/177.2 |
| 7,340,984 | B2 * | 3/2008 | Hsieh | 81/177.85 |
| 8,065,938 | B1 * | 11/2011 | Kravitch | 81/177.2 |
| 2006/0230885 | A1 * | 10/2006 | Olson | 81/177.85 |
| 2010/0212480 | A1 * | 8/2010 | Bell | 89/1.15 |

* cited by examiner

*Primary Examiner* — David B Thomas
(74) *Attorney, Agent, or Firm* — Price & Adams

(57) ABSTRACT

A shaft has a driving end and a driven end. A plurality of driving adaptors with various handles are releasably connected to the shaft driving end. A plurality of driven adaptors with various tools for performing operations within a limited space work area, such as an inaccessible space, a confined space, or keyhole excavation, are releasably connected to the shaft driven end. The driving adaptors are positioned outside of the limited space work area. The driven adaptors are positioned within the limited space work area. The handle is manipulated at the shaft driving end to transmit selected rotational and translational movements through the shaft to the tool to perform operations in the limited space work area.

6 Claims, 13 Drawing Sheets

TOOLS FOR OPERATION IN LIMITED WORK SPACE

CROSS REFERENCE TO RELATED APPLICATIONS

This application is a continuation of U.S. patent application Ser. No. 13/373,059, filed on Nov. 3, 2011, which is a continuation of U.S. patent application Ser. No. 11/401,431 filed on Apr. 10, 2006, now U.S. Pat. No. 8,065,938, issued Nov. 29, 2011.

BACKGROUND OF THE INVENTION

1. Field of the Invention

This invention relates to a method and apparatus for performing operations in limited space work areas.

2. Description of the Prior Art

Many working environments include inaccessible or limited space work areas, such as subterranean keyhole excavation spaces, underground vaults, sewers, tanks, storage bins, diked areas, vessels, silos, and other confined spaces. A confined space generally has limited or restricted means of entry or exit. A confined space is accessible to workers to the extent that it is large enough to enter and perform assigned work and is not designed for continuous occupancy. The hazards associated with a confined space may include storage of hazardous material, usage of hazardous material, hazardous activities or other hazards associated with the external environment.

Many workplaces contain spaces that meet the regulatory definitions of a confined space because their configurations impede the activities of workers who must enter and exit the space to perform work. Also, workers encounter workplaces where work is to be performed in a space that is completely inaccessible to the extent that the workers must operate tools from a position remote from or out of the inaccessible area. In many instances, a worker will face increased risk of serious physical injury, entrapment, engulfment, exposure to hazardous materials, or hazardous atmospheres. Hazardous atmospheres include atmospheres that include flammable, toxic, irritating, or corrosive components.

Some confined spaces are "permit-required" confined spaces. Permit-required confined spaces may contain or have the potential to contain a hazardous atmosphere. Permit-required confined spaces may also contain a material that has the potential to engulf an entrant. Permit-required confined spaces may also have an internal configuration that might cause an entrant to be trapped or asphyxiated by inwardly converging walls or by a floor that slopes down-ward and tapers to a smaller cross section. Permit-required confined spaces may contain any other recognized serious safety or health hazards.

The need to minimize disruption to the surrounding landscape has led to the development of minimally invasive technology or subterranean "keyhole" excavations. Subterranean keyhole excavation involves performing work above ground using extension tools to access valves, couplings, and the like on a subterranean natural gas pipeline or water line. The objective of subterranean keyhole excavation is to perform as much work underground with the smallest possible ground opening. A small opening is cut in the pavement, so that earthen material around the pipe is excavated to provide access to a particular section of the pipeline. The target holes are typically 18 inches in diameter, but may be as small as twelve inches in diameter. Typically, a valve or some fixture is replaced or repaired. These operations are performed by using tools that extend through the keyhole to the underground pipeline.

Various extension tools have been disclosed for performing conventional operations. U.S. Patent Application Publication No. 2004/0025649 discloses a wrench extension that includes an elongated member, a grip, and a pair of brackets extending from the elongated member. The grip is positioned on one end of the elongated member. One of the brackets is positioned on the opposite end. The other bracket is positioned in spaced apart manner from the first bracket, so that the brackets receive a wrench or other suitable tool. The brackets are welded onto the member.

U.S. Pat. No. 5,396,820 discloses an extensible wrench handle having a removable wrench head. The handle includes a tubular member with a telescoping extension extending therefrom. The extension is connected to the tubular member through a conventional fastening mechanism. The wrench head is pivotally attached to the extension.

U.S. Pat. No. 6,443,039 discloses a wrench having a pair of pivotally connected driving stems. One of the driving stems includes a yoke. A pin inserts through the yoke to connect the driving stems to one another.

U.S. Pat. No. 6,095,016 discloses a screw and bolt clamp drive. The drive includes a rotating elongated cylindrical rod. The rod receives a conventional power drill having a conventional chuck. The rod connects to a base frame on the opposite end. The base frame includes receives a pair of block jaws for gripping screws or bolts.

U.S. Pat. No. 5,927,161 discloses an adjustable tool extension. The extension includes a plurality of cylindrical telescoping members. A first member includes an upper end that includes a recess for receiving a drive end of a ratchet. A second member includes a drive end that can be coupled to various tools. A third member connects the first member to the second member.

Extension handles having clevis-type connections have been disclosed for performing conventional operations. U.S. Pat. No. 3,186,264 discloses an extendable wrench. The wrench includes a handle, a handle shaft, a head shaft, and a head. The handle shaft is threadedly attached to the head shaft. The head includes a socket holder that attaches to the head with a pin.

U.S. Pat. No. 5,279,189 discloses an extension tool for attaching and removing threaded components. The tool includes an arm that includes a handle, a connecting portion, and a member that connects to a fitting. A pin connects the fitting to the member.

Various extendable valve operators or valve keys for underground operations have also been disclosed. U.S. Pat. No. 5,638,590 discloses a tool for removing and replacing an operating nut on a subterranean gate. The tool includes an operating nut, a shaft, a handle, and a slide.

U.S. Pat. No. 6,776,068 discloses a valve operator for opening and closing valves in underground operations. The valve operator includes a lower member, an upper member, and a pin connecting the lower member to the upper member. The lower member includes a lower end portion that releasably engages an underground valve nut.

U.S. Pat. No. 6,364,285 discloses an extendable utility valve key having a clevis-type connection. The key includes a tubular member having a t-shaped handle. The tubular member receives a second member that connects to one of a plurality of base portions. The tubular member connects to the second member via a clevis-type connection. Accordingly, while it is known to make extended valve operators and valve keys, there is a need for an improved extension tool for operation within limited space work areas.

SUMMARY OF THE INVENTION

In accordance with the present invention there is provided a tool adaptor that includes an elongated body portion having opposite end portions. The body portion has a tool receiving end at one end portion and a locking end at an opposite end portion. The tool receiving end is adapted for connection to a tool for transmission of selected rotational and translational movement from the elongated body portion to the tool. The locking end includes a mechanism for quick connect and disconnect of the elongated body portion to a power source to facilitate transmission of selected rotational and translational movement to the locking end of the elongated body portion.

Further in accordance with the present invention, there is provide a tool adaptor that includes an elongated body portion having opposite end portions. The body portion has a tool receiving end at one end portion and a locking end at an opposite end portion. The tool receiving end is adapted for connection to a tool for transmission of selected rotational and translational movement from the elongated body portion to the tool. The locking end includes a mechanism for quick connect and disconnect of the elongated body portion to a power source for transmitting a load generated by selected rotation and translation from the power source to the elongated body portion. A stop member is positioned on the elongated body portion between the locking end and the tool receiving end for receiving the load transmitted to the elongated body portion for transfer of selected rotation and translation from the locking end to the tool receiving end.

Additionally in accordance with the present invention there is provided a method for releasably connecting a power source to a tool that includes the steps of releasably connecting one end of a tool adaptor to a power source for receiving rotational and translational movement. The opposite end of the tool adaptor is connected to a tool for performing a preselected operation. Selected rotational and translational movement is transmitted by the tool adaptor from the power source to the tool to perform a preselected operation by the tool.

Accordingly, a principal object of the present invention is to provide a tool adaptor for transmitting selected rotational and translational movement from a power source connected to one end to the adaptor to a tool connected to an opposite end of the adaptor.

Another object of the present invention is to provide a plurality of adaptors for transmitting selected rotational and translational movement to a tool positioned within a limited space and an inaccessible work area.

A further object of the present invention is to provide an adaptor releasably connect for quick connection and disconnection to an operator for transmitting selected rotational and translational movement to a tool for performing a preselected operation.

A further object of the present invention is to provide a plurality of adaptors having quick disconnect connections for assembling an extension tool.

These and other objects of the present invention will be more completely described and disclosed in the following specification, accompanying drawings, and appended claims.

DESCRIPTION OF THE PREFERRED EMBODIMENTS

Figure 1:
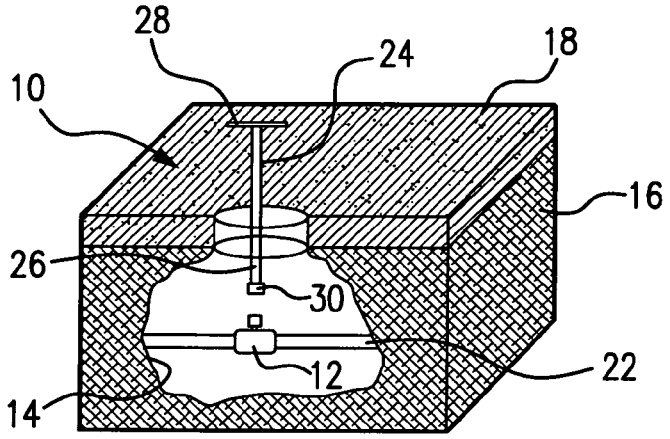
FIG. 1 is a schematic isometric view of an extension tool, illustrating a driving adaptor positioned above a limited space work area and a driven adaptor positioned within the limited space work area.

Referring to the drawings and, particularly, to FIGS. 1-18, there is shown an extension tool or operator generally designated by the numeral 10. The operator 10 is provided in unassembled and modular form as a kit, shown in FIG. 4, with instructions for assembly. The operator 10 is assembled to perform remote operations on a work piece 12 positioned within a cavity 14 in a subterranean layer 16, as shown in FIGS. 1-3.

The subterranean layer 16 is positioned below a surface 18 that includes a hole 20 that communicates with the cavity 14. The work piece 12 includes a valve, a gate, or other similar device connected to a subterranean natural gas pipeline or water line 22 positioned within the subterranean layer 16. The cavity 14 is a limited space work area, such as a permit required confined space, a keyhole excavation, or other confined space. It should also be understood in accordance with the present invention that the cavity 14 is also an inaccessible work area not permitting workers to enter the area, thereby requiring workers to manipulate the extension tool 10 remote of the work area.

Figure 2:
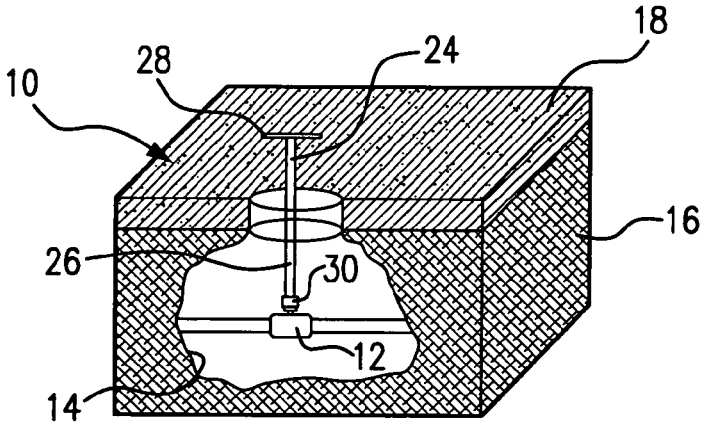
FIG. 2 is a schematic isometric view of the extension tool shown in FIG. 1, illustrating the driven end engaging a subterranean valve.
Figure 3:
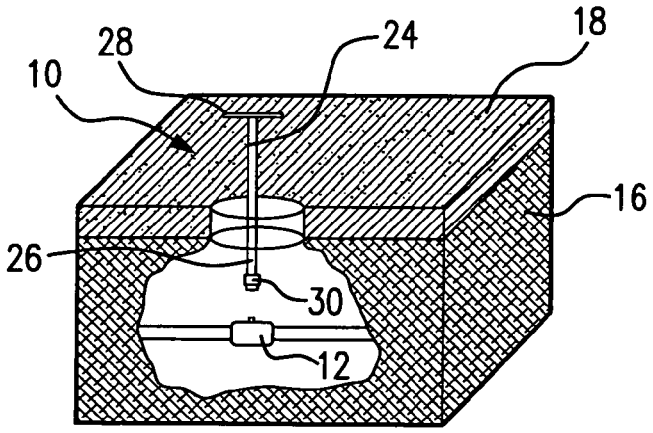
FIG. 3 is a schematic view of the extension tool shown in FIG. 1, illustrating the driven end disengaged from the subterranean valve.

As shown in FIGS. 1-3, the operator 10 includes a driving end 24 and a driven end 26. The driving end 24 is positioned above the surface 18 for manipulation by a manipulating device 28 that extends from the driving end 24. The driven end 26 is positioned below the surface 18 within the cavity 14 after the operator 10 is inserted into the hole 20. The driven end 26 includes a tool 30 extending therefrom. The driving end 24 transmits selected movements from the manipulating device 28 through the operator 10 to the driven end 26 to move the tool 30.

The operator 10 is inserted into the hole 20 to align the work piece 12 with the tool 30. Manipulating device 28 moves the tool 30 to engage the work piece 12. The driving end 24 is selectively rotated or translated through manipulation of manipulating device 28 so that the tool 30 performs an operation on the work piece 12. Upon completion of the operation, the operator 10 is withdrawn.

Figure 4:
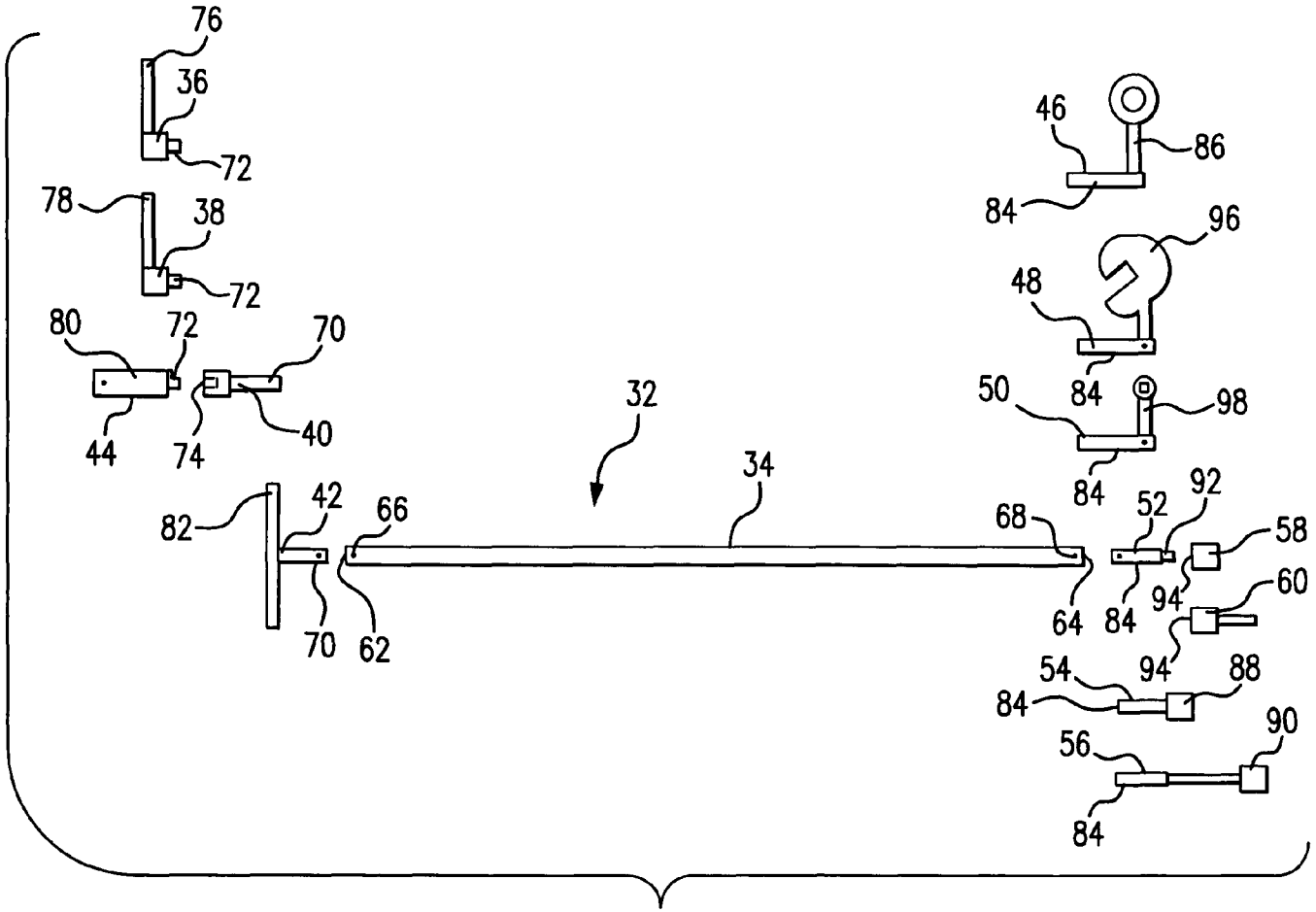
FIG. 4 is a top plan view of a kit, illustrating a plurality of interchangeable driving adaptors and driven adaptors for assembling a plurality of extension tools.

Referring now to FIG. 4, there is shown a kit generally designated by the numeral 32 for assembling a plurality of operators, including the operator 10 shown in FIGS. 1-3. The operators are specially adapted to perform rotational operations, pushing operations, pointing operations, or combinations thereof. The kit 32 comprises a number of modules that include a shaft 34, a standard drive ratchet 36, a standard drive torque wrench 38, a plurality of driving adaptors 40, 42, a breaker bar 44, a plurality of driven adaptors 46, 48, 50, 52, 54, 56, a standard socket 58 and a standard screw driver 60. The shaft is essentially solid or tubular. With this arrangement the tools, driving adaptors, driven adaptors, and shafts from modules that are interchangeable in the use of operator 10.

The shaft 34 includes a driving end 62 and a driven end 64. The shaft 34 includes a hole 66 to receive a pin or the like on adapters 40, 42 to connect the driving adaptors 40, 42 to the shaft driving end 62. It also should be understood in another embodiment that the driving adapters 40, 42 are permanently attached to the shaft 34 and can be motorized or hydraulically actuated. The shaft 34 also includes a hole 68 to connect the driven adaptors 46, 48, 50, 52, 54, 56 to the shaft driven end 64. The driving adaptors 40, 42 transmit selective rotational and translational movements through the shaft 34 to the driven adaptors 46, 48, 50, 52, 54, 56 to perform rotational operations, pushing operations, and pointing operations.

The driving adaptors 40, 42 include essentially identical interchangeable quick disconnect locking mechanisms 70 to connect to the shaft 34. The locking mechanisms 70 releasably connect to the shaft driving end 62. In the preferred embodiment, the driving end 62 is essentially identical to the driven end 64 with open-ended, tubular portions that are internally contoured to receive the locking mechanisms 70.

The driving adaptors 40, 42 connect to the shaft 34 to transmit selected rotational and translational motion in rotational, pushing, and pointing operations. In one module, the drive ratchet 36 and the drive torque wrench 38 releasably connect to the driving adaptor 40 to perform rotational operations. The breaker bar 44 releasably connects to the driving adaptor 40 to perform rotational, pushing, and pointing operations. The driving adaptor 42 directly connects to the shaft 34 to perform rotational, pushing, and pointing operations.

The drive ratchet 36, the drive torque wrench 38, and the breaker bar 44 include essentially cylindrical members 72 to facilitate connection to the driving adaptor 40. The adaptor 40 includes an essentially tubular end 74 having an inner chamber contoured to receive the members 72. The members 72 are inserted into the end 74 to releasably connect the drive ratchet 36, the drive torque wrench 38, or the breaker bar 44 to the driving adaptor 40.

The drive ratchet 36, the drive torque wrench 38, the driving adaptor 40, and the breaker bar 44 include modular manipulating devices or handles 76, 78, 80, 82. The manipulating devices 76, 78 are handles that rotate the adaptor 40 to perform a rotational operation. In another module, the manipulating device 80 includes a handle that rotates or translates the adaptor 40 to perform a rotational operation or a pushing operation. The manipulating device 82 in one embodiment is a tee handle that performs rotational operations, pushing operations, or pointing operations.

The driven adaptors 46, 48, 50, 52, 54, 56 include quick disconnect releasable locking mechanisms 84 to connect to the shaft 34 for transmission of selected rotational and translational motion during rotational, pushing, and pointing operations. The locking mechanisms 84 releasably connect to the shaft driven end 64. In the preferred embodiment, the locking mechanisms 70 are essentially identical to the locking mechanisms 84.

As shown in FIG. 4, the driven adaptors 46, 54, 56 include integral modular tools 86, 88, 90 extending therefrom. The driven adaptor 46 is a pipe threader having an integral threading tool 86. The driving adaptor 54 is a magnet adaptor having an integral magnet 88. The driving adaptor 56 is a mirror adaptor having an integral mirror assembly 90.

The driven adaptor 52 includes a locking device 92 to facilitate connection to the standard socket 58 and the standard screw driver 60. The socket 58 and the screw driver 60 include an essentially tubular ends 94 having inner chambers contoured to receive the locking device 92. The locking device 92 is selectively inserted into one of the ends 94 to releasably connect the socket 58 or the screw driver 60 to the driven adaptor 52.

The driven adaptors 48, 50 include multi-component tool assemblies or modules 96, 98. The tool assembly 96 is a pipe wrench assembly that includes alternatively a right-handed wrench, a left-handed wrench, and a vertical wrench. The tool assembly 98 is a yoke assembly.

Figure 5:
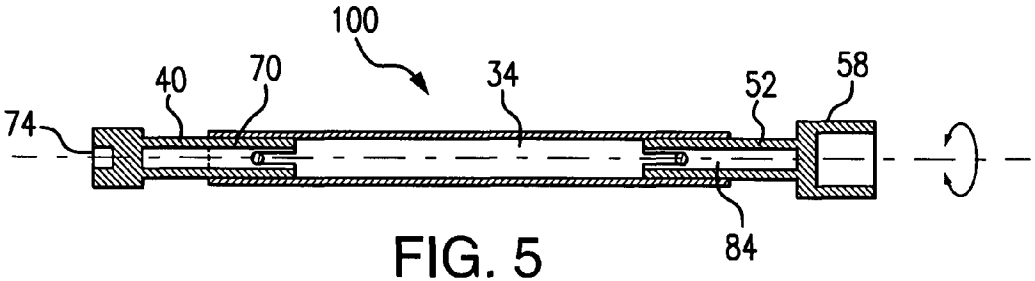
FIG. 5 is a cross sectional view in side elevation of an extension tool for performing rotational operations.

Referring now to FIG. 5, there is shown a modular operator generally designated by the numeral 100 specially adapted for performing rotational operations. The operator 100 is assembled from the shaft 34, the driving adaptor 40, the driven adaptor 52, and the socket 58. In the preferred embodiment, the driving adaptor end 74 includes a standard drive socket that facilitates manipulation of the operator 100 and the socket 58 includes a pipe plug socket that engages a work piece 12 shown in FIGS. 1-3.

The driving adaptor 40 includes a locking mechanism 70 that releasably connects the driving adaptor 40 to the shaft driving end 62. The driven adaptor 52 includes a locking mechanism 84 that releasably connects the driven adaptor 52 to the shaft driven end 64. The locking mechanisms 70, 84 allow the driving adaptor 40 to transfer a load through the shaft 34 for transfer to the driven adaptor 52.

The drive socket 74 engages a conventional rotating tool adaptor (not shown) that is powered through manual manipulation or a conventional driving power source (not shown). The power source rotates the drive socket 74 to rotate the driving adaptor 40. The rotational movement of the driving adaptor 40 is transmitted to the driven adaptor 52 by the rotational movement of the shaft 34. The driven adaptor 52 rotates the pipe plug socket 58 to perform an operation on the work piece 12 shown in FIGS. 1-3.

Figure 6:
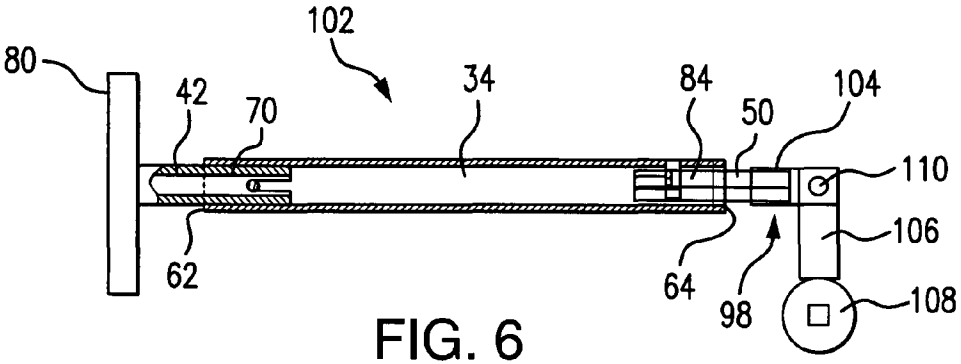
FIG. 6 is a cross sectional view in side elevation of an extension tool for performing reciprocating translational operations.

Referring now to FIG. 6, there is shown a modular operator generally designated by the numeral 102 specially adapted for performing pushing operations. The operator 102 is assembled from the shaft 34, the driving adaptor 42, and the driven adaptor 50. The driving adaptor 42 includes a tee handle 80 to facilitate manipulation. The tee handle 80 in one embodiment is releasably connected to shaft 34 via locking mechanism 70 and in another embodiment is integral with or permanently secured to shaft 34. The driven adaptor 50 includes a yoke assembly 98 with a yoke 104, a fulcrum pin 106, and ratchet assembly 108.

The driving adaptor 42 shown in FIGS. 5 and 6 includes the locking mechanism 70 that releasably connects the driving adaptors 40, 42 to the shaft driving end 62. The driven adaptor 50 includes a locking mechanism 84 that releasably connects the driven adaptor 50 to the shaft driven end 64. The locking mechanisms 70, 84 allow the driving adaptor 42 to transfer a load through the shaft 34 for transfer to the driven adaptor 50.

The tee handle 80 is manipulated to extend and retract the shaft 34 in a reciprocating motion. The shaft 34 transmits the reciprocating motion to the yoke assembly 98, so that yoke 104 moves in a reciprocating motion. The reciprocating yoke 104 pivots the fulcrum pin 106 about a pivot point 110 to rotate the ratchet assembly 108.

Figure 7:
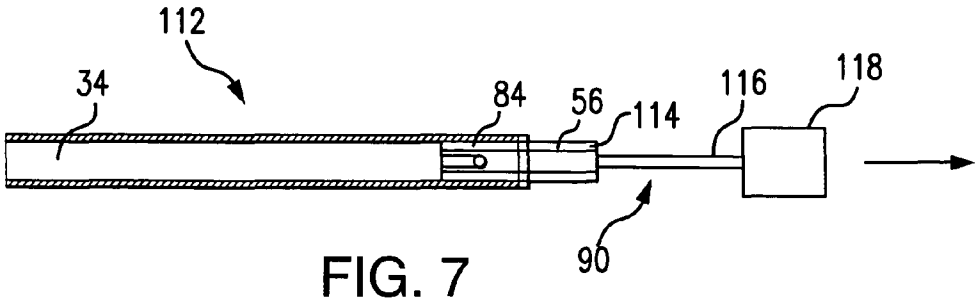
FIG. 7 is a cross sectional view in side elevation of an extension tool for performing translational operations.

Referring now to FIG. 7, there is shown a modular operator generally designated by the numeral 112 specially adapted for performing pointing operations. The operator 112 is assembled from the shaft 34 and the driven adaptor 56 shown. The driven adaptor 56 includes a locking mechanism 84 for releasably connecting to the shaft driven end 64 and an integral mirror assembly 90. The mirror assembly 90 includes a body portion 114, an elongated member 116, and a mirror 118.

The shaft 34 is manipulated for translational or rotational movement within a limited space work area 14 shown in FIGS. 1-3. The shaft 34 transmits the translational or rotational movements to the driven adaptor 56 to move the driven adaptor 56 into a preselected position within the work area 14. The shaft 34 aligns the mirror 118 with a light source (not shown) to facilitate observation of a work piece 12.

Figure 8:
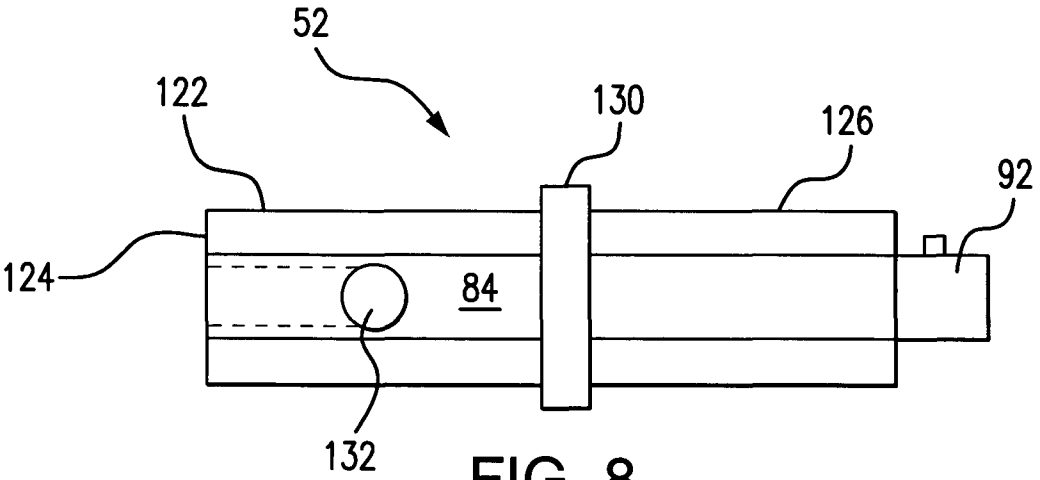
FIG. 8 is top plan view of a driven adaptor, illustrating a standard socket drive.
Figure 9:
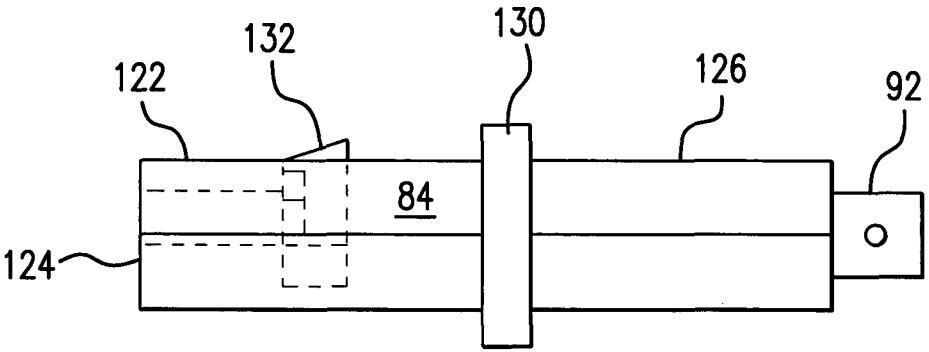
FIG. 9 is a side view of the driven adaptor shown in FIG. 8.
Figure 10:
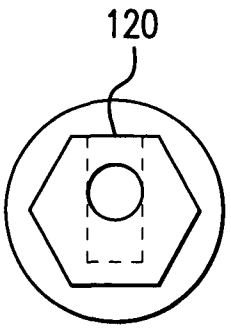
FIG. 10 is an end view of the driven adaptor shown in FIG. 8.

Referring now to FIGS. 8-12, the driven adaptor 52 shown in FIG. 8 includes a body 126 having a locking portion 122 positioned at one end 124 and a tool portion 126 positioned at the opposite end 128. The locking portion 122 includes a locking mechanism 84 and a stop washer 130. The tool portion 120 includes the locking device 92 for releasably connecting the driving adaptor 52 to the standard socket 58 and the standard screw driver 60 shown in FIG. 4.

Figure 11:
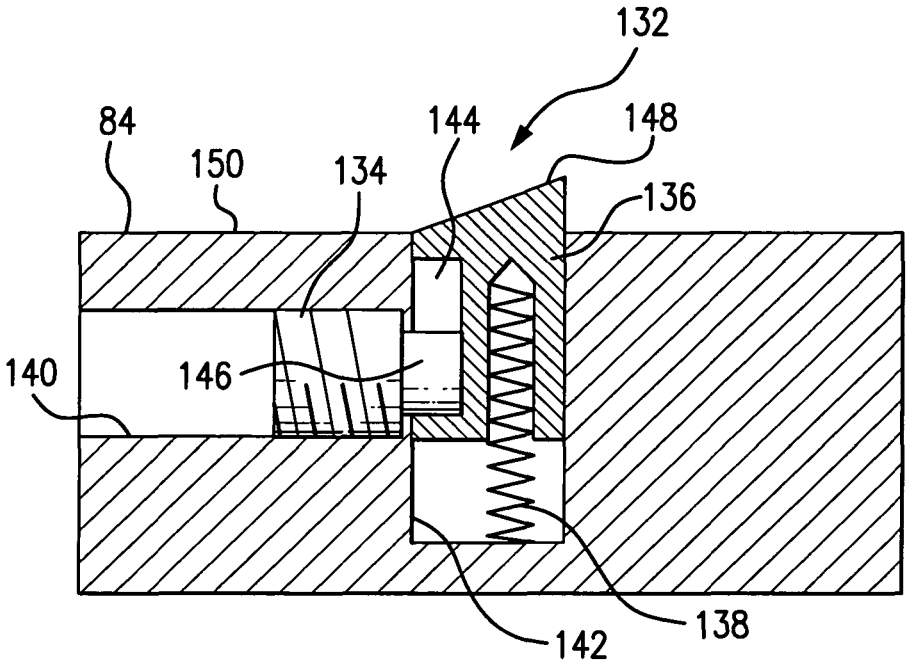
FIG. 11 is a cross sectional view in side elevation of an adaptor pin assembly of the driven adaptor, illustrating a detent in a locked position.
Figure 12:
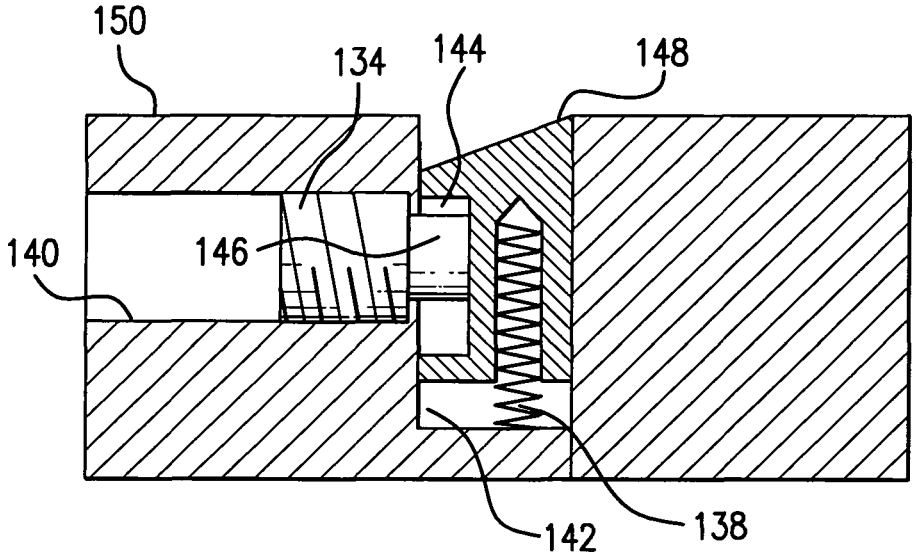
FIG. 12 is a cross sectional view in side elevation of the adaptor pin assembly shown in FIG. 11, illustrating the detent in an unlocked position.

As shown in detail in FIGS. 11 and 12, the locking mechanism 84 includes a detent pin assembly 132 having a set screw 134, a pin 136, and a spring 138. The set screw 134 is positioned within a horizontal bore 140 in the driven adaptor 52. The pin 136 and the spring 138 are positioned within a vertical channel 142 in the driven adaptor 52 that intersects the horizontal bore 140. The spring 138 is positioned to extend and retract the pin 136 within the channel 142. The pin 136 includes a vertical channel 144 that receives a tip 146 that extends from the set screw 134. The set screw tip 146 prevents the spring 138 from ejecting the pin 136 from the vertical channel 142.

The pin 136 includes a beveled upper surface 148 that facilitates connection of the driven adaptor 52 to the shaft 34 shown in FIG. 4. The driven adaptor 52 is inserted into the shaft 34, so that an internal surface (not shown) of the shaft driven end 64 slides against an outer surface 150 of the driven adaptor 52 and the pin upper surface 148. As the pin upper surface 148 frictionally engages the shaft 34 internal surface, the pin 136 is lowered into the channel 142. The shaft 34 internal surface frictionally engages the pin upper surface 148 until the hole 68 is aligned with the pin 136. Once the hole 68 is aligned with the pin 136, the spring 138 raises the pin 136 for insertion through the hole 68 to releasably connect the driven adaptor 52 to the shaft 34.

Figure 13:
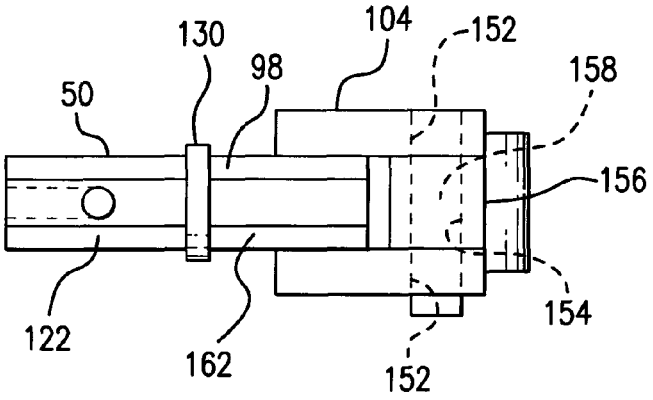
FIG. 13 is top plan view of a driven adaptor, illustrating a yoke assembly releasably connected to the driven adaptor.
Figure 14:
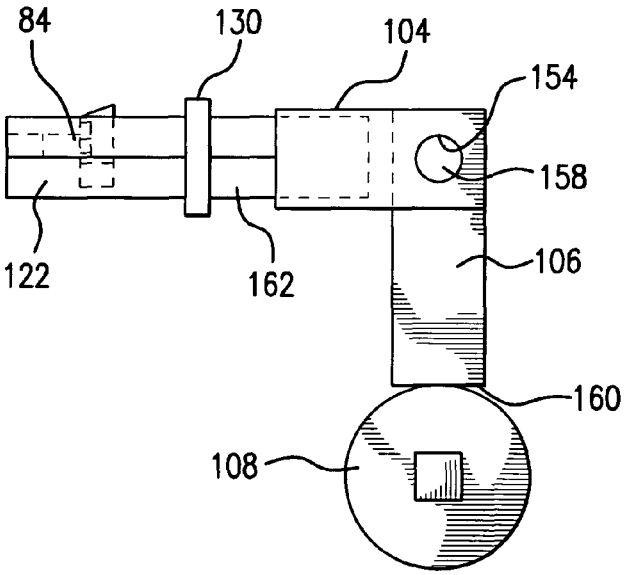
FIG. 14 is a side view of the driven adaptor shown in FIG. 13, illustrating the yoke assembly.
Figure 15:
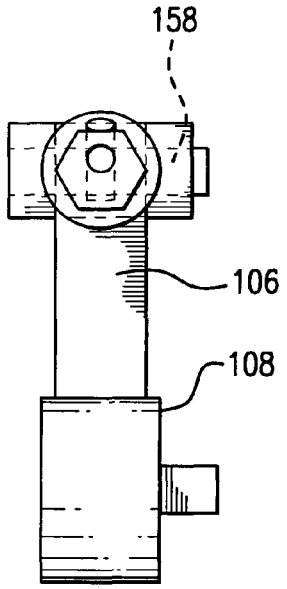
FIG. 15 is an end view of the driven adaptor shown in FIG. 13, illustrating the yoke assembly.

Referring now to FIG. 13-15, there is shown the driven adaptor 50 having the yoke assembly 98 with the yoke 104, fulcrum pin 106, and ratchet assembly 108. The yoke 104 is a bifurcated member that includes a pair of holes 152. The fulcrum pin 106 includes a hole 154 at one end 156. The holes 152, 154 align with one another to receive a set screw 158 to pivotally connect the yoke 104 to the fulcrum pin 106. The fulcrum pin 106 is integrally connected to the ratchet assembly 108 at the opposite end 160.

The yoke 104 includes a locking portion 122 and a tool portion 162. The locking portion 122 includes a locking mechanism 84 and a stop washer 130. The locking mechanism 84 releasably connects the shaft 34 shown in FIG. 6 to the driven adaptor 50. The stop washer 130 prevents the shaft 34 from sliding against the driven adaptor 50 to facilitate load transfer from the shaft 34 to the driven adaptor 50.

Figure 16:
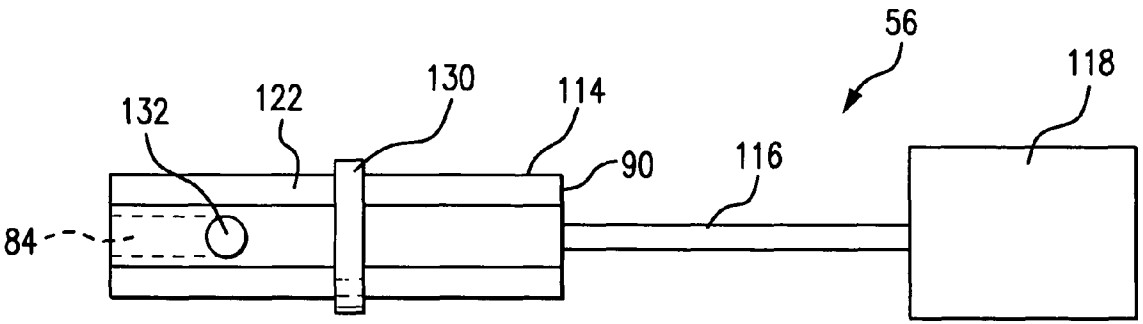
FIG. 16 is top plan view of a driven adaptor, illustrating a mirror assembly releasably connected to the driven adaptor.
Figure 17:
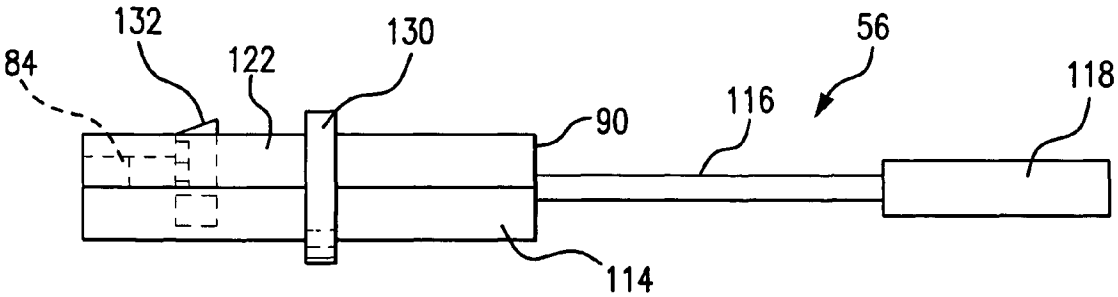
FIG. 17 is a view in side elevation of the driven adaptor shown in FIG. 16, illustrating the mirror assembly.
Figure 18:
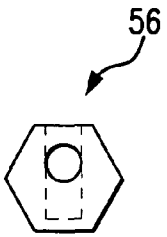
FIG. 18 is an end view of the driven adaptor shown in FIG. 16.

Referring now to FIGS. 16-18, there is shown the mirror adaptor 56 having a locking portion 122 and a mirror assembly 90. The locking portion 122 includes a locking mechanism 84 and a stop washer 130. The locking mechanism 84 includes a detent pin assembly 132 as above described and illustrated in FIGS. 11 and 12. The mirror assembly 90 includes a body portion 114, an elongated member 116, and a mirror 118. The elongated member 116 extends from the body portion 114. The mirror 118 extends from the elongated member 116.

Figure 19:
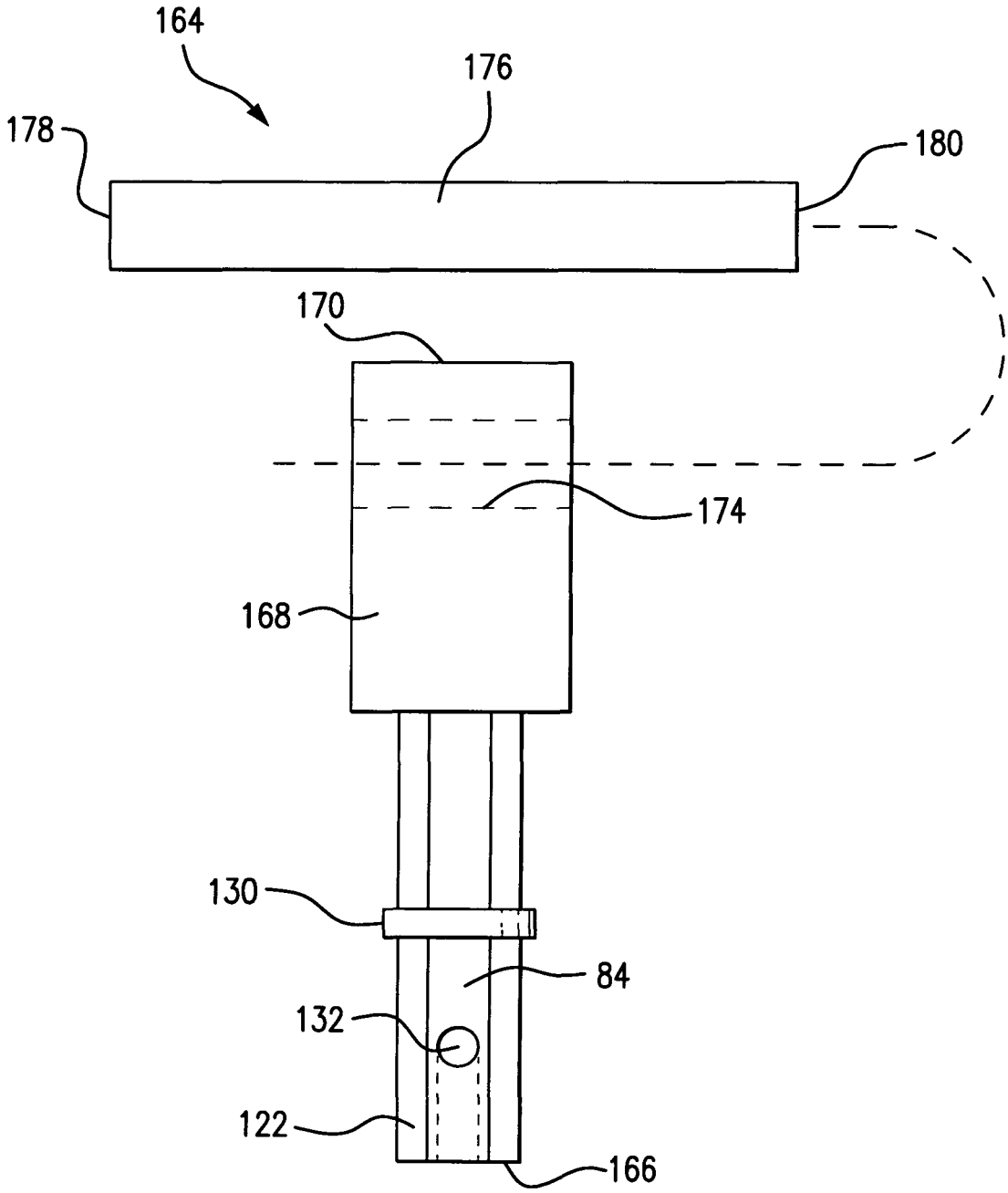
FIG. 19 is a top plan view of a driving adaptor, illustrating a removable tee handle.

Referring now to FIG. 19, there is shown another embodiment of a driving adaptor 164. The driving adaptor 164 includes a locking portion 122 positioned at one end 166 and manipulating device 168 positioned at the opposite end 170. The locking portion 122 includes a locking mechanism 84 and a stop washer 130. The locking mechanism 84 includes a detent pin assembly 132, as above described.

Manipulating device 168 includes an essentially cylindrical bore 174 extending through end portion 170. The bore 174 receives a removable cylindrical rod 176. The rod 176 is inserted into the bore 174 to facilitate gripping on either end 178 or 180 of rod 176.

Figure 20:
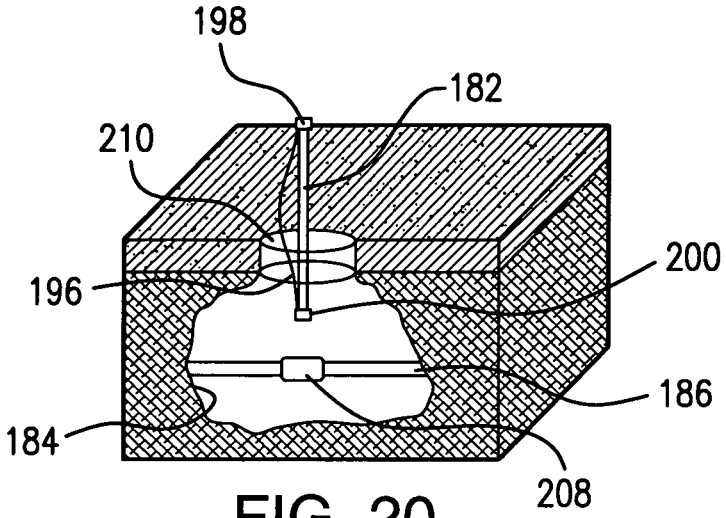
FIG. 20 is a schematic isometric view of another embodiment of an extension tool.
Figure 21:
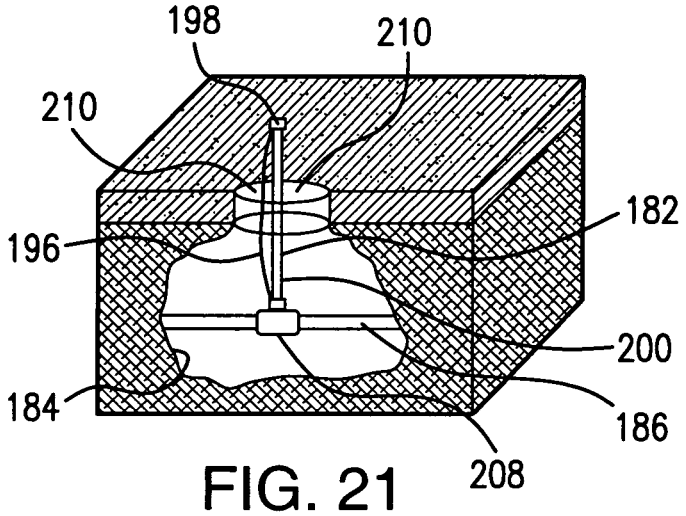
FIG. 21 is a schematic isometric view of the extension tool shown in FIG. 20, illustrating the driven end engaging a subterranean coupling.
Figure 22:
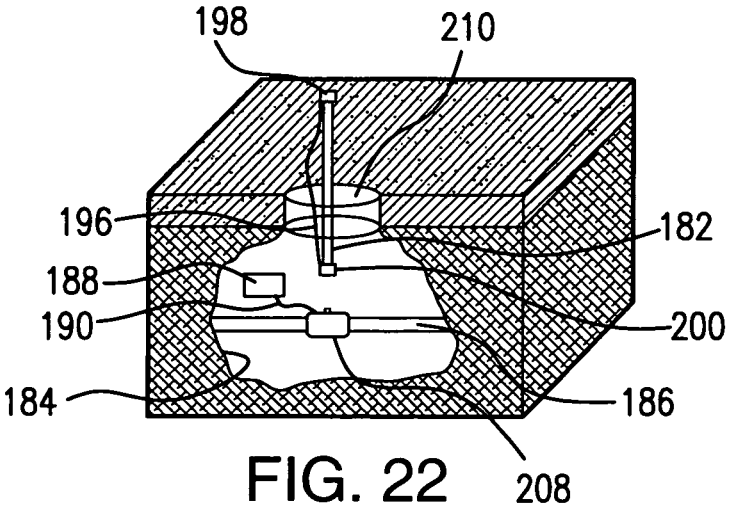
FIG. 22 is a schematic view of an extension tool shown in FIG. 20, illustrating the driven end disengaged from the subterranean coupling.

Referring now to FIGS. 20-23, there is shown another embodiment of a modular extension tool or operator 182 for installing a galvanic protection device on a pipe within a limited space work area 184. The operator 182 is specially adapted to provide galvanic protection to an underground pipeline 186 by attaching a plate 188 to the pipeline 186, as shown in FIG. 22. The plate 188 is a sacrificial cathode or anode. Preferably, the operator 182 connects a wire 190 (FIG. 22) extending from a zinc plate 188 to the pipeline 186 with a Cadweld® exothermic welding system or Exolon® exothermic welding system provided by Erico, Inc. of Solon, Ohio. Exolon® connections are metallurgically similar to Cadweld® connections but are designed primarily for indoor or confined spaces.

Figure 23:
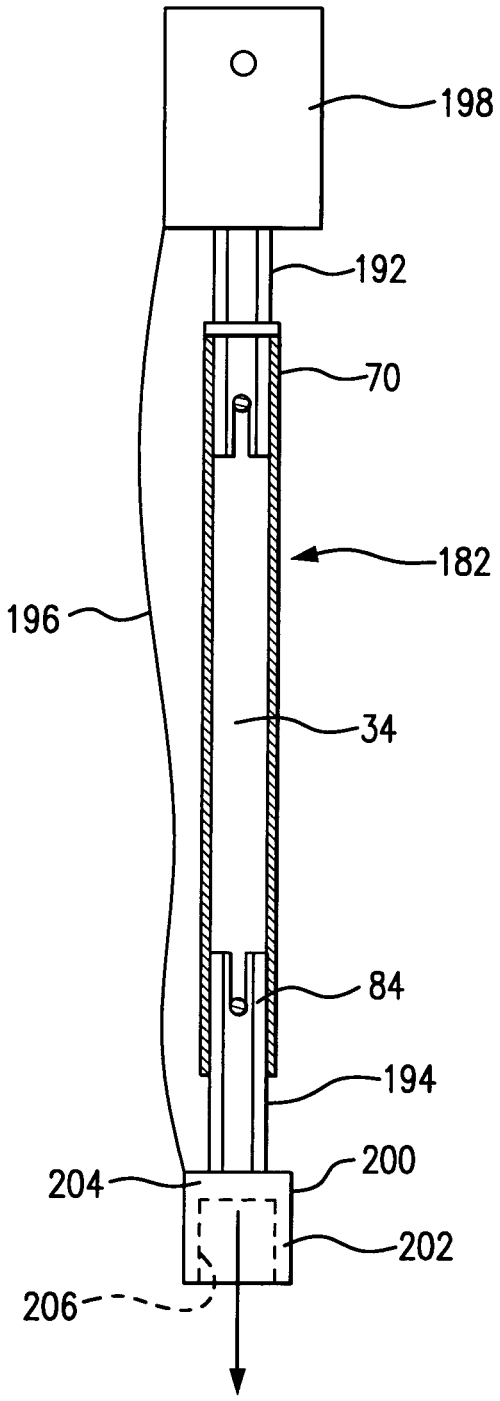
FIG. 23 is a cross sectional view in side elevation of an extension tool for performing cathodic connection operations.

As shown in FIG. 23, the operator 182 includes a shaft 34, a driving adaptor 192, a driven adaptor 194, and a detonation cord 196. The driving adaptor 192 includes a locking mechanism 70 and a detonator 198. The driven adaptor 194 includes a locking mechanism 84 and a mold 200. The detonation cord 196 connects the detonator 198 to the mold 200.

The mold 200 includes an essentially tubular outer wall 202 and a base 204 that define a cavity 206. The wire 190, not shown in FIGS. 20 and 21, is releasably mounted on the outer wall 202 of mold 200. The wire 190 with the plate 188 connected thereto is lowered through opening 210 into the limited space work area 184 by manipulation of the operator 182 into position on the pipeline 186. The wall 202 and the base 204 are made from any suitable material. Preferably, the wall 202 and the base 204 are made from graphite materials, cordierite, or refractory ceramics. The graphite materials typically provide an average life of at least fifty separate exothermic welds. Exolon® molds utilize a dual element filter system (not shown) that removes 97% of the smoke during installation.

The mold 200 includes a package or cartridge of explosive material and weld metal for connecting the wire 190 to a coupling 208 positioned on the pipeline 186, as shown in FIG. 22. The detonation cord 196, the detonator 198, and the mold 200 are electrically connected to one another to form an electric ignition system. The detonator 198 is a suitable detonator for delivering, a suitable electric current to the mold 200 to activate the explosive material and melt the weld metal within the cavity 206. Preferably, the detonator 198 includes a low voltage battery.

The wire 190 connected to plate 188, the coupling 208, and the weld metal are made from any suitable material. Preferably, the wire 190 and the coupling 208 are made from aluminum, copper, iron, steel, cast iron that do not include phosphorous, magnesium, caustic substances, toxic substances, or explosive substances. The weld metal preferably includes copper oxide, aluminum, and not less than 3% tin as the wetting agent. The materials for the wire 190, the coupling 208, and the weld metal are selected for galvanic compatibility.

The operator 182 is inserted into a hole 210, so that the driven adaptor 194 is positioned within the limited space work area 184. The driving adaptor 192 is manipulated to transmit translational movement through the shaft 34 to the driven adaptor 194. The driven adaptor 194 positions the mold 200 with the attached wire 190 and plate 188 in contact with coupling 208. The detonator 198 is actuated to transmit an electrical current through the detonation cord 196 to the mold 200 to ignite the explosive material. The weld metal is melted to weld the wire 190 to the coupling 208. After the welding is completed, the wire becomes disengaged from the mold 200 when the operator 182 is raised out of the work area. The wire 190 connected to the coupling 208 and metal plate 188 remain in work area 184.

Figure 24:
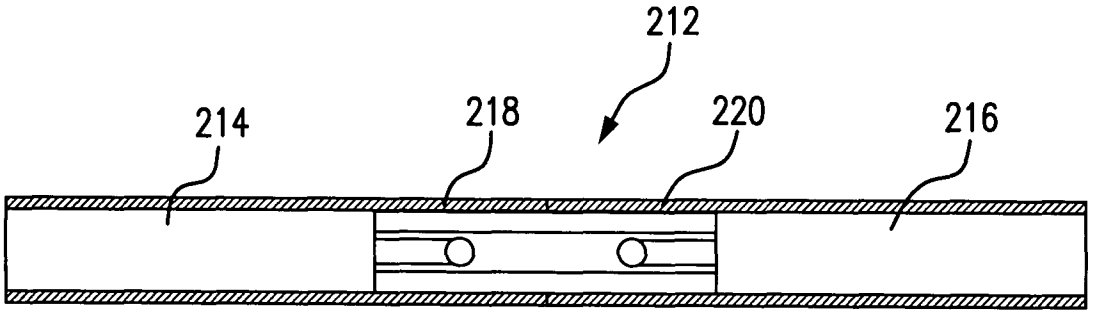
FIG. 24 is a top plan sectional view of a shaft having a pair of members connected by a pair of locking mechanisms.

Referring now to FIG. 24, there is shown another embodiment of a shaft 212 for connecting the driving adaptors 40, 42 shown in FIG. 4 to the driven adaptors 46, 48, 50, 52, 54, 56 also shown in FIG. 4. The shaft 212 includes a pair of members 214, 216. Each member 214, 216 includes an essentially tubular end 218, 220. Each end 218, 220 receives a member (not shown) that includes a locking mechanism (not shown) on each end to connect the members 214, 216 to one another. The locking mechanisms are essentially identical to the locking mechanisms 70, 84 shown in FIG. 4.

Figure 25:
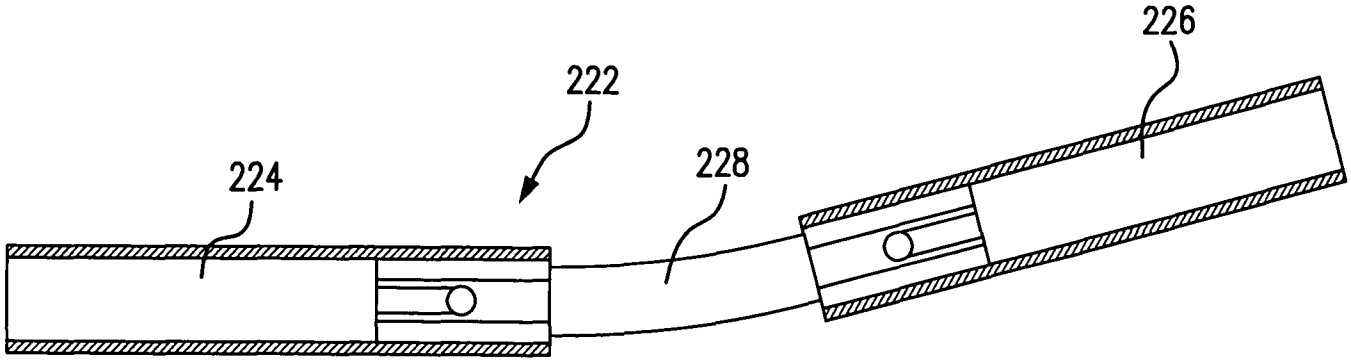
FIG. 25 is a top plan sectional view of a shaft having a pair of rigid members connected by a flexible member.

Referring now to FIG. 25, there is shown another embodiment of a shaft 222 for connecting the driving adaptors 40, 42 shown in FIG. 4 to the driven adaptors 46, 48, 50, 52, 54, 56 shown in FIG. 4. The shaft 222 includes a pair of rigid tubular members 224, 226 manufactured from any suitable material connected by a flexible member 228 manufactured from any suitable material. An example of a commercially available product suitable for use as the flexible member 228 is an Elliot Flexible Shaft provided by the Elliot Manufacturing Co. of Binghampton, N.Y.

The flexible member 228 is particularly suitable for rotational operations where one of the members 224 is displaced from or out of axial alignment with the other member 226, so that the center line of the member 224 is not collinear with the center line of the member 226. The displacement of the member 224 relative to the member 226 provides the ability to rotate the driven adaptors 46, 48, 50, 52, 54, 56 in a different plane than the driving adaptors 40, 42. Rotating driven adaptors 46, 48, 50, 52, 54, 56 and driving adaptors 40, 42 in different planes enhances the ability position the driven adaptors 46, 48, 50, 52, 54, 56 within a limited space work area.

Figure 26:
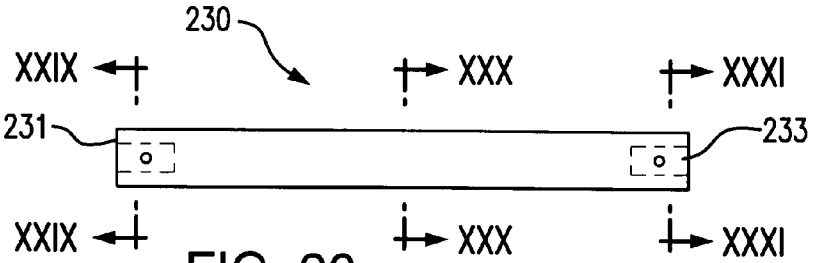
FIG. 26 is a top plan view of a shaft for connecting driving adaptors to driven adaptors.

Referring now to FIGS. 26-31, there is shown a plurality of shafts 230, 232, 234 for connecting the driving adaptors 40, 42 shown in FIG. 4 to the driven adaptors 46, 48, 50, 52, 54, 56 shown in FIG. 4. As shown in FIG. 26, the shaft 230 has a driving end 231 and a driven end 233 and an essentially constant outer configuration throughout its length, which include the geometric cross sections shown in FIGS. 30A-H. In various embodiments shown in FIGS. 30A-H, the shaft 230 is essentially solid with a square cross section 236A, a circular cross section 236B, a hexagonal cross section 236C, or a octagonal cross section 236D. In other embodiments, the shaft 230 is tubular with an outer surface 238E-H and an inner surface 240E-H.

Figure 27:
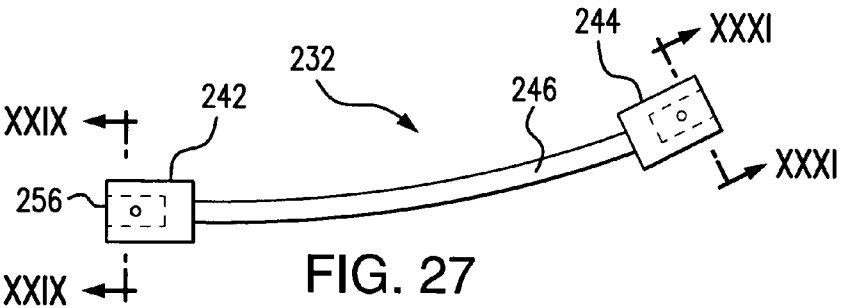
FIG. 27 is a top plan view of a further embodiment of a shaft having a flexible member.
Figure 28:
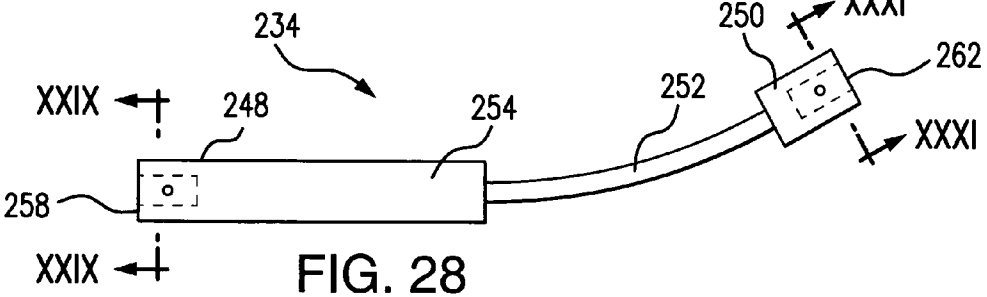
FIG. 28 is a top plan view of another embodiment of a shaft having a flexible member and a rigid member.
Figure 31:
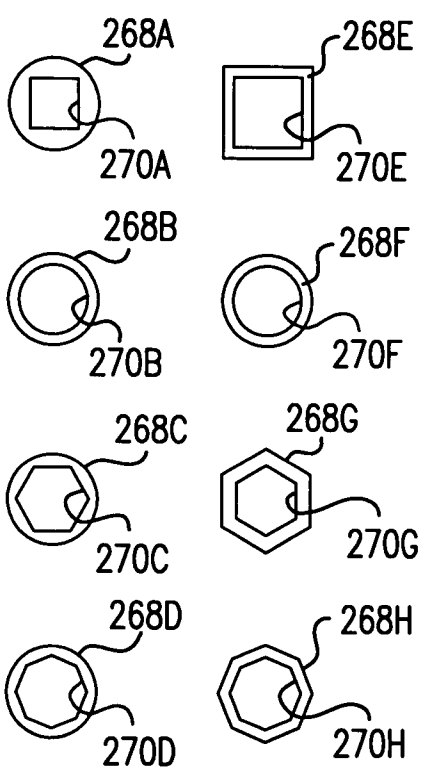
FIGS. 31A-31H are cross sectional views in side elevation of the shafts shown in FIGS. 26-28 taken along lines XXXI-XXXI in FIGS. 26-28.
Figure 30:
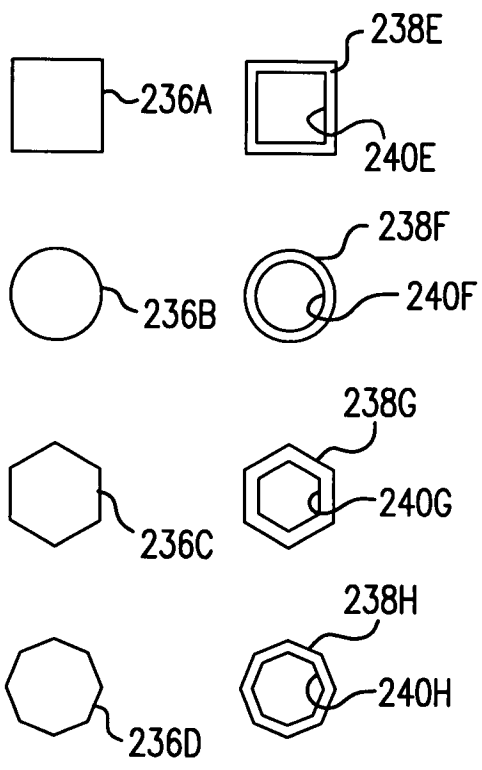
FIGS. 30A-30H are cross sectional views in side elevation of the shaft shown in FIG. 26 taken along line XXX-XXX in FIG. 26.
Figure 29:
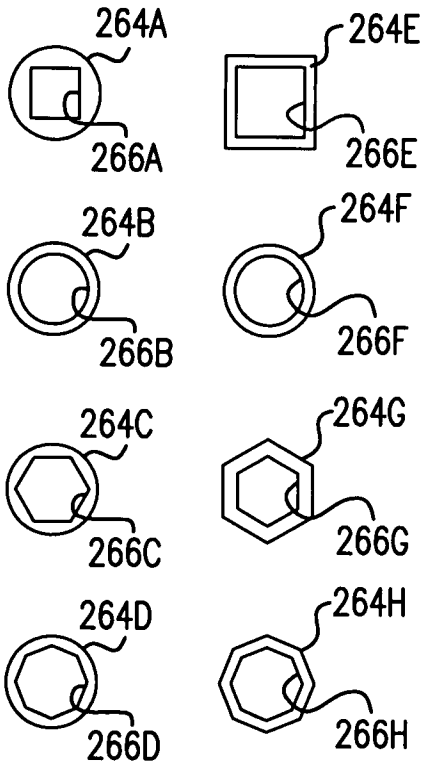
FIGS. 29A-29H are cross sectional views in side elevation of the shafts shown in FIGS. 26-28 taken along lines. XXIX-XXIX in FIG. 26.

As shown in FIG. 27, the shaft 232 includes a pair of locking portions 242, 244 connected by a flexible member 246. The shaft 234 shown in FIG. 28 includes a pair of locking portions 248, 250 connected by a flexible member 252 and a rigid member 254. The rigid member 254 is integrally connected to one of the locking portions 248. The locking portions 242, 248 include driving ends 256, 258. The locking portions 244, 250 include driven ends 260, 262.

The driving ends 256, 258 are essentially tubular having the geometric cross sectional configurations shown in FIGS. 29A-H. The outer surface of each driving end 256, 258 has a circular configuration 264A-D and 264F, a square configuration 264E, a hexagonal configuration 264G, or an octagonal configuration 264H. The inner surface has a square configuration 266A and 266E, a circular configuration 266B and 266F, a hexagonal configuration 266C and 266G, or an octagonal configuration 266D and 266H.

The driven ends 260, 262 are essentially tubular having the geometric cross sectional configurations shown in FIGS.

31A-H. The outer surface of each driven end 260 and 262 has a circular configuration 268A-D and 268F, a square configuration 268E, hexagonal configuration 268G, or an octagonal configuration 268H. The inner surface has a square configuration 270A and 270E, a circular configuration 270B and 270F, a hexagonal configuration 270C and 270G, or an octagonal configuration 270D and 270H.

It should be understood that alternative driving adaptors and driven adaptors are contemplated in accordance with the present invention and include locking mechanisms in which detent pins are replaced by set screws. Also, the driving adapters in selected operations are formed integral with the driving end 24 of the operator 10. It should also be understood that an alternative yoke assembly is contemplated in accordance with the present invention in which a set screw in the yoke assembly is replaced with a welded pin, a through pin, a cotter pin, or the like. It should also be understood that an alternative shaft is contemplated in accordance with the present invention in which the shaft includes a plurality of telescoping members.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for performing operations in a confined space comprising, a shaft having a driven end positioned within the confined space and a driving end positioned outside of the confined space, a driven adaptor positioned adjacent to said shaft driven end within the confined space with a tool portion extending therefrom, a locking mechanism connecting said shaft to said driven adaptor to allow quick engagement and disengagement of said shaft to said driven adaptor, said locking mechanism connected to said shaft to transmit selected rotational and translational movement from said shaft to said driven adaptor tool portion, a tool releasably connected to said driven adaptor tool portion, and an operator connected to said shaft driving end for selectively transmitting rotational and translational movement from said shaft through said driven adaptor to said tool for performing a selected operation in the confined space.

2. Apparatus for performing operations in a confined space as set forth in claim 1 in which, said tool releasably connected to said driven adaptor is a pipe wrench assembly.

3. Apparatus for performing operations in a confined space as set forth in claim 1 in which, said tool releasably connected to said driven adaptor is a pipe plug socket for engaging a workpiece.

4. Apparatus for performing operations in a confined space as set forth in claim 1 in which, said tool releasably connected to said driven adaptor is a mirror assembly for alignment with a light source to facilitate observation of a workpiece in the confined space.

5. Apparatus for performing operations in a confined space as set forth in claim 1 which includes, a detonator supported by said operator on said shaft positioned outside of the confined space, a mold containing explosive material connected to said driven adaptor, and detonator cord electrically connecting said detonator to said mold to form an electric ignition system whereby electric current is transmitted from said detonator through said detonation cord to said mold to ignite the explosive material in said mold within the confined space.

6. Apparatus for performing operations in a confined space as set forth in claim 1 which includes, a hydraulic power source connected to said operator for hydraulically transmitting selected rotational and translational movement from said shaft to said driven adaptor tool portion to perform rotational, pushing, and pointing operations in the confined space.

* * * * *